US007604367B2

(12) United States Patent
Tsao

(10) Patent No.: US 7,604,367 B2
(45) Date of Patent: Oct. 20, 2009

(54) WATERTIGHT MECHANISM FOR FLOODLIGHT

(76) Inventor: Frank Tsao, Caster Lighting Inc., Nan-Ser Administration District Chashan, Dongguan, Guangdong (CN)

( * ) Notice: Subject to any disclaimer, the term of this patent is extended or adjusted under 35 U.S.C. 154(b) by 63 days.

(21) Appl. No.: 11/383,917

(22) Filed: May 17, 2006

(65) Prior Publication Data

US 2007/0236942 A1 Oct. 11, 2007

(30) Foreign Application Priority Data

Apr. 7, 2006 (CN) ..... 2006 2 0057426 U

(51) Int. Cl.
*F21V 33/00* (2006.01)

(52) U.S. Cl. ..... 362/101; 362/267

(58) Field of Classification Search ..... 362/267, 362/101, 253, 257, 260, 268, 280, 306, 310, 362/311, 323, 340, 359, 361, 362, 368, 374, 362/375, 433, 455, 477, 497, 540, 546, 548, 362/549, 645; 220/3.3, 378; 174/50, 52, 174/17 VA See application file for complete search history.

(56) References Cited

U.S. PATENT DOCUMENTS 2,831,964 A * 4/1958 Diedring ..... 362/311
3,156,416 A * 11/1964 Griffin ..... 362/549
5,060,121 A * 10/1991 Cunningham et al. ..... 362/548
5,295,054 A * 3/1994 Baader et al. ..... 362/542
5,508,894 A * 4/1996 Payne et al. ..... 362/485
5,584,574 A * 12/1996 Haddad ..... 362/359
5,664,866 A * 9/1997 Reniger et al. ..... 362/477
5,845,803 A * 12/1998 Saito et al. ..... 220/378
6,174,067 B1 * 1/2001 Thrasher et al. ..... 362/101
6,492,590 B1 * 12/2002 Cheng ..... 174/50
7,244,048 B2 * 7/2007 Poggi ..... 362/267

* cited by examiner

*Primary Examiner*—Hargobind S Sawhney
(74) *Attorney, Agent, or Firm*—Sonnenschein Nath & Rosenthal LLP; Bryan P. Stanley

(57) ABSTRACT

A kind of watertight light fitting with light shade and light frame is provided. The exterior surface of the shade wall is even and smooth and inside the shade is installed an annular waterproof lining. The exterior edge side of the waterproof liner matches well with the interior side of the shade wall. A barrier wall stretches out from around the surface of the waterproof lining toward the light frame. The barrier wall keeps a certain distance to the exterior edge side of the waterproof lining. The barrier wall, together with the upper surface of the waterproof lining and the shade wall, forms a watertight groove. A watertight gasket is fixed inside the groove. The benefit of the waterproof lining with the watertight groove being formed partly by the waterproof lining is that the shade wall is fairly thin without requiring an outstretched step on the exterior surface of the shade wall. This reduces the raw material for producing the light shade as well as the weight of the shade. As a result, the product quality is ensured with decreased manufacturing defects and the cost is lower. In addition, the light fitting is aesthetically pleasing.

10 Claims, 3 Drawing Sheets

WATERTIGHT MECHANISM FOR FLOODLIGHT

This application claims priority pursuant to 35 U.S.C. 119 (a) to Chinese Patent Application No. 200620057426.1 filed Apr. 7, 2006, the entire disclosure of which is incorporated herein by reference.

FIELD OF THE INVENTION

The present invention relates generally to a light fitting. More specifically, the present invention is concerned with a light fitting having a watertight construction.

BACKGROUND OF THE INVENTION

Light fittings which require watertightness, such as outside lights, diving lights and so on, must be equipped with a gasket at the joint of the light shade and the light frame (or lens frame) to achieve watertightness. The gasket, which is usually made from elastic material like silica gel or latex is maintained at the joint of the light shade and the light frame. When the light shade and the light frame are locked together, the elastic and gasket will fill in the gap at the joint so as to form a hermetic seal and ensure watertightness.

The general method of retaining a gasket at the joint is to make a groove in the light shade for inserting the gasket. The gasket has a greater height than the depth of the groove, so as to protrude a little bit over the groove to ensure the gasket fills in the gap at the joint when the light shade is locked tightly to the light frame, making the light fitting watertight.

The groove for retaining the gasket is usually made directly on the light shade. There are two specific methods for making the groove. FIGS. 1 and 2 illustrate the two different methods of the prior art. As shown in FIG. 1, one method for making the groove is to make an outstretched step (or annular flange) 2 around the outer edge of the light shade to form groove 3 for inserting the gasket at the joint between the edge side of the flange and the shade wall. This method is particularly useful when the wall of light shade is somewhat thin. This kind of light fitting is not aesthetically pleasing because of the outstretched step 2. As shown in FIG. 2, a second method for making the groove is to make the wall of shade 4 thicker and make a gasket groove 5 directly on the wall of shade 4. This kind of light fitting has even and smooth outside surfaces but is heavy and impractical for easy use. It is also costly because of the thicker shade wall which utilizes excessive material. Furthermore, the amount of defective product obtained during manufacture is high. Therefore, it is desirable to provide an aesthetically pleasing watertight light with a thin wall that it is cost effective.

SUMMARY OF THE INVENTION

A principal object of the instant invention is to provide a kind of watertight light with a shade that is aesthetically pleasing and has a thinner wall. The light fittings applying the present invention have a shade with even and smooth outside surfaces and annular waterproof lining. The exterior edge side of the waterproof lining fits well with the interior side of the shade wall. A barrier wall stretching toward the light frame is made on the surface of the waterproof lining with some distance to the shade wall. This barrier wall, together with the upper surface of waterproof lining and the shade wall, forms a groove for inserting a gasket. The shade wall is made relatively thin according to normal manufacturing requirements. The retention area for the gasket is made inside the shade when the detachable lining is made. When fixed inside the shade, the lining will form a gasket groove together with the shade wall. Since it is not necessary to make an outstretched step on the exterior surface of the shade wall to leave enough space for the gasket groove, the light fitting has a nice and smooth exterior surface and a relatively thin shade wall.

As an improvement, the thickness of the gasket is larger than the depth of the groove. The light frame is equipped with a glass plate which presses against the gasket. A flange stretches out from around the inside wall of light frame, the outstretching flange has a barrier stretching away from the frame. The barrier presses against the glass plate. The glass plate is installed between the shade and the frame.

As another improvement, the light frame has a protrusion on its surface joining with the waterproof lining. The protrusion matches with the groove. It stretches into the groove, pressing against the gasket and keeping it inside the groove.

As an improvement, the frame and the shade coincide with each other at the exterior edge of their joint, which makes the whole light fitting more attractive.

As a further improvement, three or more underpinning stretch out from the interior surface of the shade wall for retaining the gasket, simplifying the structure.

The preferred embodiments of the present invention utilizing a waterproof lining and a watertight groove that is set on the waterproof lining result in a shade wall that is fairly thin so it is not necessary to make an outstretching step on the exterior surface of the shade wall. These designs reduce the raw material for producing the light shade as well as the weight of the shade. As a result, product quality is ensured with decreased defects and the cost to manufacture is lower. In addition, the light fitting is aesthetically pleasing.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

A preferred embodiment of the invention, illustrative of the best mode in which the applicant has contemplated applying the principles, is set forth in the following description and is shown in the drawings and is particularly and distinctly pointed out and set forth in the appended claims.

DETAILED DESCRIPTION OF A PREFERRED EMBODIMENT

As required, a detailed embodiment of the present inventions is disclosed herein; however, it is to be understood that the disclosed embodiments are merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
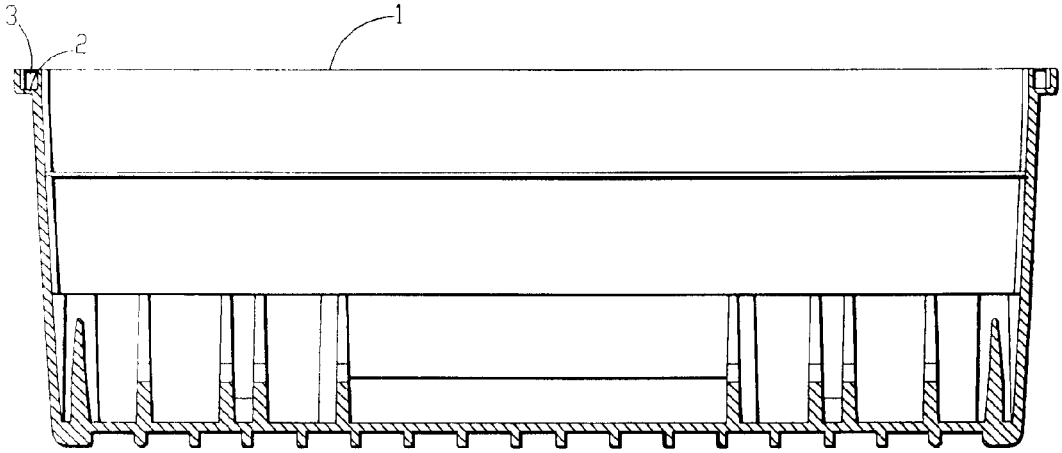
Fig. 1. Prior Art
FIG. 1 is a cutaway view of a prior art light shade.
Figure 2:
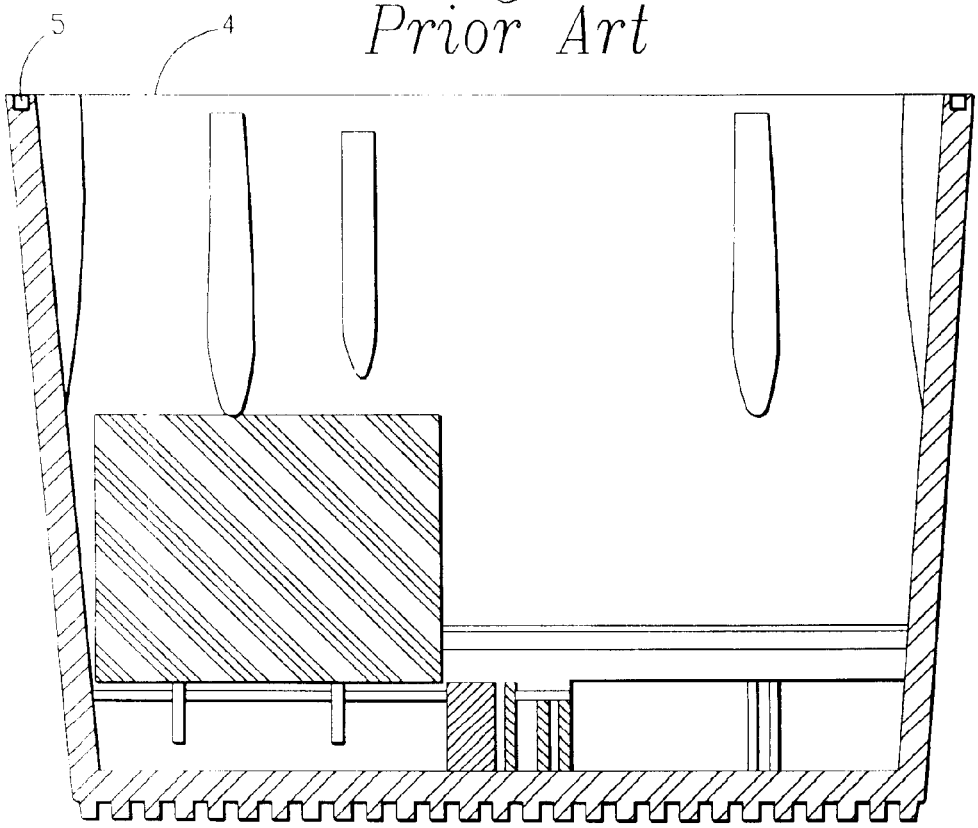
Fig. 2. Prior Art
FIG. 2 is a cutaway view of another prior art light shade.
Figure 3:
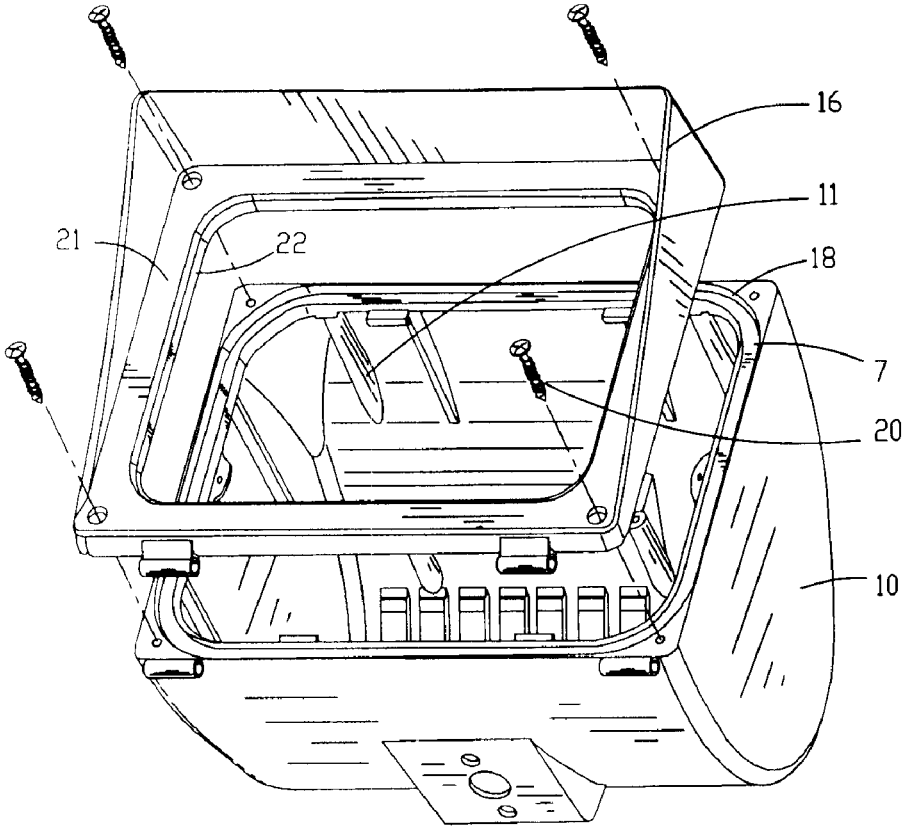
FIG. 3 is an exploded perspective view of a light fixture of the instant invention.

The watertight light of a first embodiment of the instant invention is described, in part, with reference to FIGS. 2 and 3. As shown in FIGS. 2 and 3, the light fitting is composed of light shade 10, light frame 16, glass plate 17, and waterproof lining 18. Four underpinnings 11 stretch out from around the inside of the shade wall, the underpinnings have screw eyes, waterproof lining 18 has holes matching with the screw eyes in the underpinnings. Waterproof lining 18 is fixed with screws on the underpinnings 11 inside light shade 10.

The exterior edge side of the waterproof lining 18 matches with the interior side of light shade 10. Barrier wall 15 stretches out from around the surface of waterproof lining 18 upward toward light frame 16. Barrier wall 15 is located a fixed distance from the exterior edge side of waterproof lining 18. Barrier wall 15, together with the upper surface of waterproof lining 18 and the interior wall of light shade 10, forms a groove for inserting watertight gasket 19. Watertight gasket 19 is waterproof and is retained inside the groove. The thickness of watertight gasket 19 is greater than the depth of the groove. Glass plate 17 is located on watertight gasket 19.

Protrudent flange 21 stretches out from around the interior side of the wall of light frame 16, protrudent flange 21 has barrier 22 stretching away from the light frame, with barrier 22 pressing against glass plate 17 when light frame 16 is fixed with screws 20 upon light shade 10, and glass plate 17 presses against watertight gasket 19 so as to ensure watertightness.

Figure 4:
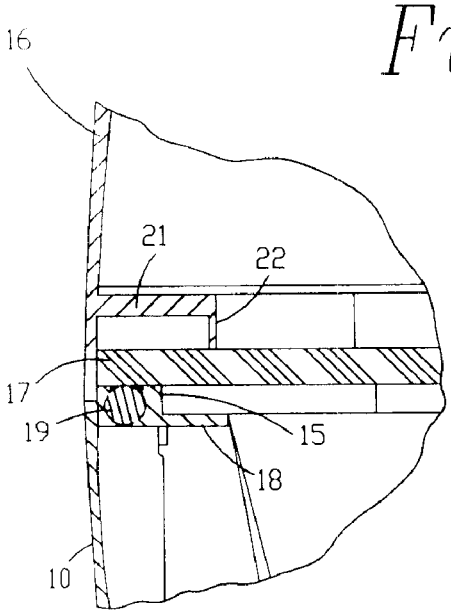
FIG. 4 is a partial magnified cutaway view taken at the center point of FIG. 3 showing a first embodiment of the instant invention.
Figure 5:
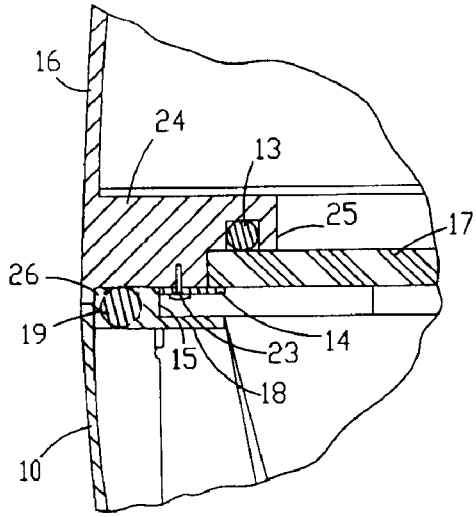
FIG. 5 is a partial magnified cutaway view taken at the center point of FIG. 3 showing a second embodiment of the instant invention.
Figure 6:
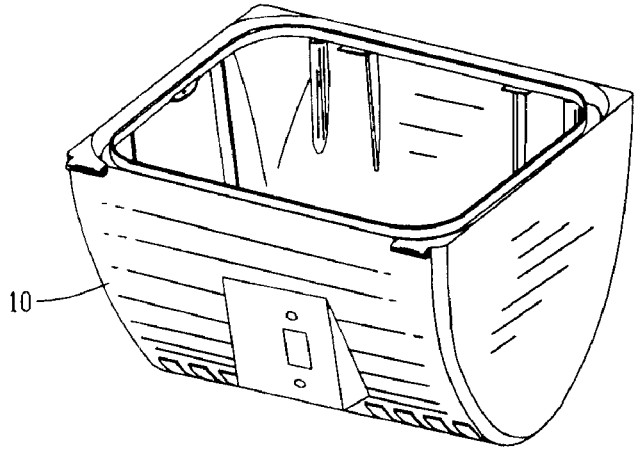
FIG. 6 is a perspective view of the instant invention illustrating a waterproof lining nested within a light shade to cooperatively form a u-shaped groove.
Figure 7:
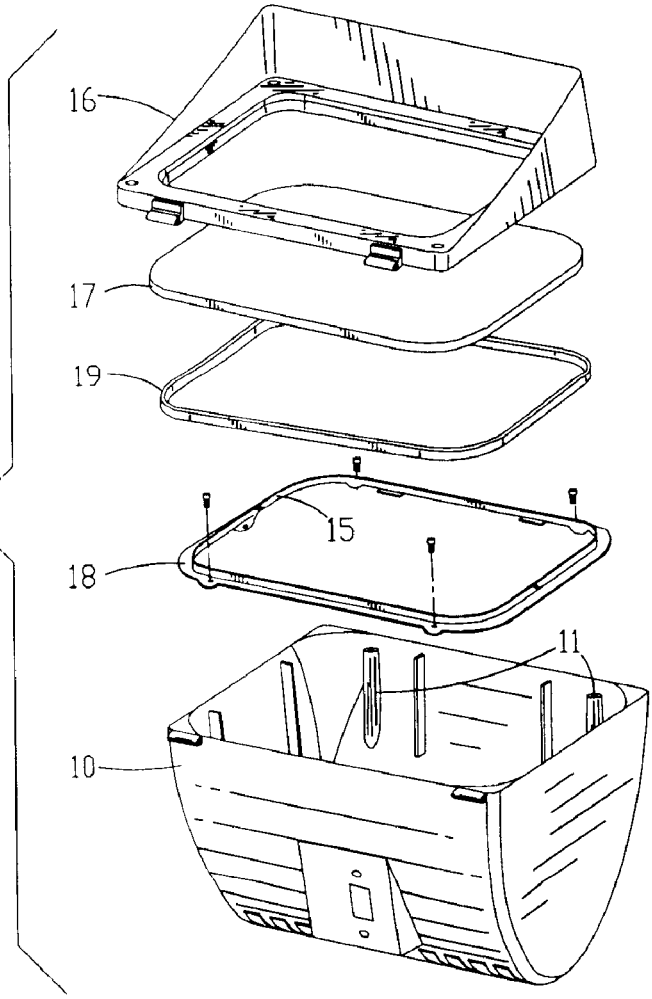
FIG. 7 is an exploded view of the instant invention illustrating an order of assembly of a plurality of elements.

The watertight light of another preferred embodiment of the instant invention is described, in part, with reference to FIGS. 3, 4, and 7. As shown in FIGS. 3, 4, and 7, the light fitting is composed of light shade 10, light frame 16, glass plate 17, and waterproof lining 18. Four underpinnings 11 stretch out from around the inside of the shade wall. There are screw eyes in the underpinnings 11. Waterproof lining 18 has holes matching with the screw eyes in the underpinnings 11. Waterproof lining 18 is fixed with screws on the underpinnings 11 inside the light shade 10.

The exterior edge side of waterproof lining 18 matches with the interior side of the wall of light shade 10 while barrier wall 15 stretches out from around the surface of waterproof lining 18 toward light frame 16. Barrier wall 15 is located a fixed distance from the exterior edge side of waterproof lining 18. Barrier wall 15, together with the upper surface of waterproof lining 18 and the inner wall of light shade 10, forms a groove for inserting watertight gasket 19. Watertight gasket 19 is retained inside the groove.

FIG. 4 illustrates a second embodiment having a protrudent flange 24 that stretches out from around the inside wall of light frame 16. Protrudent flange 24 has barrier 25 stretching out from the light frame. A watertight groove is formed between barrier 25 and protrudent flange 24 in which there is retained gasket 13. Glass plate 17 presses against gasket 13. Pressing plate 14 fixes glass plate 17 with screws 23 upon light frame 16 so as to ensure watertightness between glass plate 17 and light frame 16. Protrudent flange 26 is on the surface of light frame 16. Protrudent flange 26 will stretch into the watertight groove and press against watertight gasket 15 when light frame 16 is fixed upon light shade 10, so as to ensure watertightness. Underpinnings 11 are also located in a watertight space.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A watertight light fitting comprising:

a light shade including an exterior surface that is even and smooth, and an annular waterproof lining within the light shade, wherein an exterior edge side of the waterproof lining matches well with an interior side of the light shade;

a light frame including a barrier wall that stretches out and around a surface of the waterproof lining away from the light frame, the barrier wall being located a fixed distance from the exterior edge side of the waterproof lining, wherein the barrier wall, together with an upper surface of the waterproof lining and the shade, forms a watertight groove to retain a watertight gasket having a thickness greater than the depth of the groove;

glass plate located on the watertight gasket such that the glass plate presses against the watertight gasket; and a protruding flange stretching out from around the interior side of the light shade, wherein the protruding flange has a barrier stretching out toward the light frame and the glass plate is installed between the light shade and the light frame.

2. The watertight light fitting as claimed in claim 1 wherein the shade wall and the waterproof lining form a u-shaped groove to retain the watertight gasket.

3. The watertight light fitting as claimed in claim 2 wherein the barrier wall closes the u-shaped groove to form the watertight groove to retain the watertight gasket.

4. A watertight light fitting comprising:

a light shade including an exterior surface that is even and smooth and an annular waterproof lining within the light shade, wherein an exterior edge side of the waterproof lining matches with an interior side of the light shade; and a light frame including a barrier wall that stretches out and around a surface of the waterproof lining away from the light frame, the barrier wall being located a fixed distance from the exterior edge side of the waterproof lining, wherein the barrier wall, an upper surface of the waterproof lining, and the shade wall form a watertight groove to retain a watertight gasket, wherein there is a protruding flange on the surface of the light frame at the joint with the waterproof lining such that the protruding flange is adapted to stretch into the watertight groove and press against the watertight gasket.

5. The watertight light fitting as claimed in claim 4 wherein the shade wall and the waterproof lining form a u-shaped groove to retain the watertight gasket.

6. The watertight light fitting as claimed in claim 5 wherein the barrier wall closes the u-shaped groove to form the watertight groove to retain the watertight gasket.

7. A watertight light fitting comprising:

a light shade including an exterior surface;

an annular waterproof lining within the light shade, wherein an exterior edge side of the waterproof lining matches with an interior side of the light shade; and a light frame including a barrier wall that stretches out and around a surface of the waterproof lining away from the light frame, the barrier wall being located a fixed distance from the exterior edge side of the waterproof lining, wherein the barrier wall, an upper surface of the waterproof lining, and the shade wall form a watertight groove to retain a watertight gasket, wherein three or more underpinnings stretch out from around the interior side of the shade wall and the waterproof lining is fixed with screws upon the underpinnings inside the light shade.

8. The watertight light fitting as claimed in claim 7 wherein the light frame and the light shade coincide with each other at the exterior edge of the joint.

9. The watertight light fitting as claimed in claim 7 wherein the shade wall and the waterproof lining form a u-shaped groove to retain the watertight gasket.

10. The watertight light fitting as claimed in claim 9 wherein the barrier wall closes the u-shaped groove to form the watertight groove to retain the watertight gasket.

* * * * *